US005866251A

United States Patent [19]

Bastioli et al.

[11] Patent Number: 5,866,251

[45] Date of Patent: Feb. 2, 1999

[54] DEVICE AND PROCESS FOR THE PRODUCTION OF FIBRIOUS STARCH MATERIALS

[75] Inventors: Catia Bastioli, Novara; Bruno Casale, Cameri; Gino Zanardi, Pernate, all of Italy

[73] Assignee: Eridania Beghin-Say, Vilvoorde, Belgium

[21] Appl. No.: 746,453

[22] Filed: Nov. 12, 1996

Related U.S. Application Data

[63] Continuation of Ser. No. 244,488, filed as PCT/EP93/02782 Oct. 11, 1993, abandoned.

[30] Foreign Application Priority Data

Oct. 16, 1992 [IT] Italy ..... TO92A0837

[51] Int. Cl.[6] ..... D02G 3/00; B29D 31/00; B29C 65/00; D01F 9/00

[52] U.S. Cl. ..... 428/364; 428/393; 428/394; 264/41; 264/186; 264/209.1; 425/67; 425/70; 425/71; 425/404

[58] Field of Search ..... 264/41, 186, 209.1; 425/67, 70, 71, 404; 428/364, 393, 394

[56] References Cited

U.S. PATENT DOCUMENTS

| | | | |
|---|---|---|---|
| 1,500,931 | 7/1924 | Hooper | 425/67 |
| 2,046,577 | 7/1936 | Sellner et al. | 425/67 |
| 2,804,646 | 9/1957 | Gonsalves | 425/67 |
| 2,902,336 | 9/1959 | Hiemstra et al. | 264/186 |
| 2,988,782 | 6/1961 | Parrish et al. | 264/69 |
| 3,068,527 | 12/1962 | Morgan | 264/143 |
| 3,452,129 | 6/1969 | Isobe et al. | 425/67 |
| 3,488,344 | 1/1970 | Biffi et al. | 425/67 |
| 4,205,025 | 5/1980 | Hart et al. | 264/14 |
| 4,243,480 | 1/1981 | Hernandez et al. | 162/141 |
| 5,254,303 | 10/1993 | Ostertag et al. | 425/67 |

FOREIGN PATENT DOCUMENTS 2258251 2/1993 United Kingdom .

*Primary Examiner*—Patrick Ryan
*Assistant Examiner*—J. M. Gray
*Attorney, Agent, or Firm*—Cushman Darby & Cushman IP Group of Pillsbury Madison & Sutro, LLP

[57] ABSTRACT

A process and device produce fibrous starch materials through extrusion of a dispersion or aqueous solution of starch material in a flow of saline coagulant. The dispersion or aqueous solution is extruded through a microporous tubular wall in an annular chamber surrounding the microporous wall to obtain an extrusion flux of starch material which surrounds the tubular wall. Coagulation of the starch material is carried out by feeding a flow of coagulation agent in the annular chamber parallel to the extrusion surface. The fibers obtained from the process or device are able to be used in the paper sector as a substitution for or in combination with cellulose fibers.

20 Claims, 2 Drawing Sheets

DEVICE AND PROCESS FOR THE PRODUCTION OF FIBRIOUS STARCH MATERIALS

This is a continuation of application Ser. No. 08/244,488, filed as PCT/EP93/02782 Oct. 11, 1993, now abandoned.

BACKGROUND OF THE INVENTION

The present invention refers to a device and process for production of fibrous starch materials particularly destined for use in the production of paper and cardboard.

It is known that if aqueous colloid dispersions of starch in typical concentrations of between 5 and 40% by weight of anhydrous solid, is brought into contact with non-solvents (for example a saline solution of ammonium sulphate), it coagulates forming flakes of gel.

U.S. Pat. No. 4,205,025 describes a process for the production of fibrils used as paper pulp using film forming polymers including substantially water-soluble starches. By the term "fibrils", materials showing a hybrid morphology which is between a film and a fiber are intended. The film forming polymer is dissolved in water to form a solution which is then injected into a precipitating means, preferably an organic non-solvent, such as an alcohol or a ketone, with the application of shearing stress in order to obtain the formation of fibrils which are then rendered more hydrophobic through subsequent treatment in an insolublising agent.

U.S. Pat. No. 4,340,442 describes a process for the formation of fibrils which, in order to improve the hydrophobic properties of the fibrils, uses starch insoluble in water having a high amylose content (50–80% by weight), which is coagulated in a saline solution, in particular ammonium sulphate. Said starch which is substantially insoluble in water, requires a stage in which it is dissolved in alkaline solution which causes problems in the coagulation stage and problems with respect to disposal of sulphates different from ammonium salts, which are formed in said stage.

U.S. Pat. No. 4,139,699 describes a process for the production of a product having starch fiber morphology, through extrusion of a colloidal starch dispersion having a high amylopectin content in a coagulating agent. In the case where a starch having a amylopectin content of less than approximately 95% is used, it is necessary to chemically modify the starch to ensure the colloidal dispersion thereof in the aqueous system or, alternatively, the starch must be dissolved in the presence of alkaline hydroxides.

The use of alkaline hydroxides, particularly sodium hydroxide, makes the industrial application of the process described difficult, in that the coagulation stage carried out using ammonium sulphate results in the production of ammonia and formation of large quantities of sodium sulphate preventing coagulation and causing problems with respect to disposal.

U.S. Pat. No. 4,243,480 describes a process that uses the product obtained according to the process described in U.S. Pat. No. 4,139,699, for the production of paper or cardboard according to conventional paper making technology. Said product has a short fiber morphology having a diameter of between 10 and 500 microns and a length of between 0.1 and 3 mm, obtained by extruding the starch dispersion via a die into a moving coagulation bath.

U.S. Pat. No. 4,853,168 describes a process of the type described in U.S. Pat. No. 4,139,699, in which the colloidal starch dispersion adapted to be extruded is obtained by cooking an aqueous starch dispersion containing the coagulating saline solution.

In the above cited patent literature and in practical experimentation, various known devices can be used in order to finely break down the starch solution or dispersion and therefore favour a close contact with the coagulating agent, such as atomization nozzles, ejectors, mixers with stirrers, spinnerets or syringes. It has however been demonstrated experimentally that the type of device used strongly influences the final coagulated product and its properties. Devices in which the starch is coagulated in highly turbulent conditions (such as ejectors) or in which there is no ordered speed profile (mixers with stirrers), do not give rise to products with a fibrous structure, but somewhat provoke a fragmentation of the starch, with formation of flat scales (rolled onto each other) or a three dimensional aggregate.

The dimensions of these non fibrous products vary with the operating conditions and influence the characteristics of them. In the production process very small particles are lost during the separation and slow down the filtering operation in that they block the cloth; if used in the production of paper, they are not retained on the flat cloth with consequential loss of starch in the paper and an increase of COD in the paper factory waste water. On the other hand, very large particles do not integrate with the cellulose matrix fibers giving rise to defects in the produced paper.

Other negative aspect, verified for fibrids obtained from the previously described processes, consists of rather high water retention and solubility values.

A further product obtained from starch by coagulation processes, but having a fiber morphology, partly reduces the above listed disadvantages in that, thanks to its fibrous structure, it increases its compatibility with the cellulose fibers, reduces the water retention in that it is more easily filterable and reduces its solubility as it has a lower specific surface.

It would therefore be desirable to have a production of a product having fiber morphology, with dimension, size distribution and physical chemical properties such to be suitable for the production of paper and cardboard and in addition to be obtainable from low cost starch such as starch from maize or potato without adopting alkaline solutions of starch for the starch used.

SUMMARY OF THE INVENTION

In light of such a purpose, the object of this invention is a process for the production of fibrous starch materials through extrusion of a dispersion or aqueous solution of starch material in a flow of saline coagulant agent characterised by the fact that it comprises the operation of:

- extruding the dispersion or aqueous solution through a microporous tubular wall in a chamber circularly ringed with said microporous wall in such a way to obtain an extrusion flux of the starch material which surrounds the said tubular walls and
- carry out the coagulation of the extrusion by feeding the flow of the coagulation agent in the annular chamber parallel to the extrusion surface.

Another object of the invention is a fiber making device characterised by the fact that it comprises:

- a tubular body comprising first means of entry for feeding the flux of starch material,
- a feeding chamber for the starch material connecting the said first means of entry,
- an annular outlet chamber of the starch material, a tubular element with porous walls coaxially arranged with said outlet chamber and interposed between this and the feeding chamber, the tubular element being adapted to allow starch material to extrude through the porous walls in the said outlet chamber into a variety of threads of starch material forming a envelope around the tubular element, a second means of entry connecting the outlet chamber for feeding the coagulating agent flow and means of discharge arranged downstream from the annular outlet chamber.

It has been found that by using the process and device of the present invention it is possible to obtain a product which shows a shape ratio having a particularly narrow size distribution and centred in the range of 75–150 microns and having a water solubility, determined by the "Anthrone Test" further described later, of less than about 2% and a low water retention.

BRIEF DESCRIPTION OF THE DRAWINGS

Other advantages and characteristics of the process, device and product obtained according to the present invention will be further illustrated in detail in the following with reference to the enclosed drawings in which.

DESCRIPTION OF THE PREFERRED EMBODIMENTS

Figure 1:
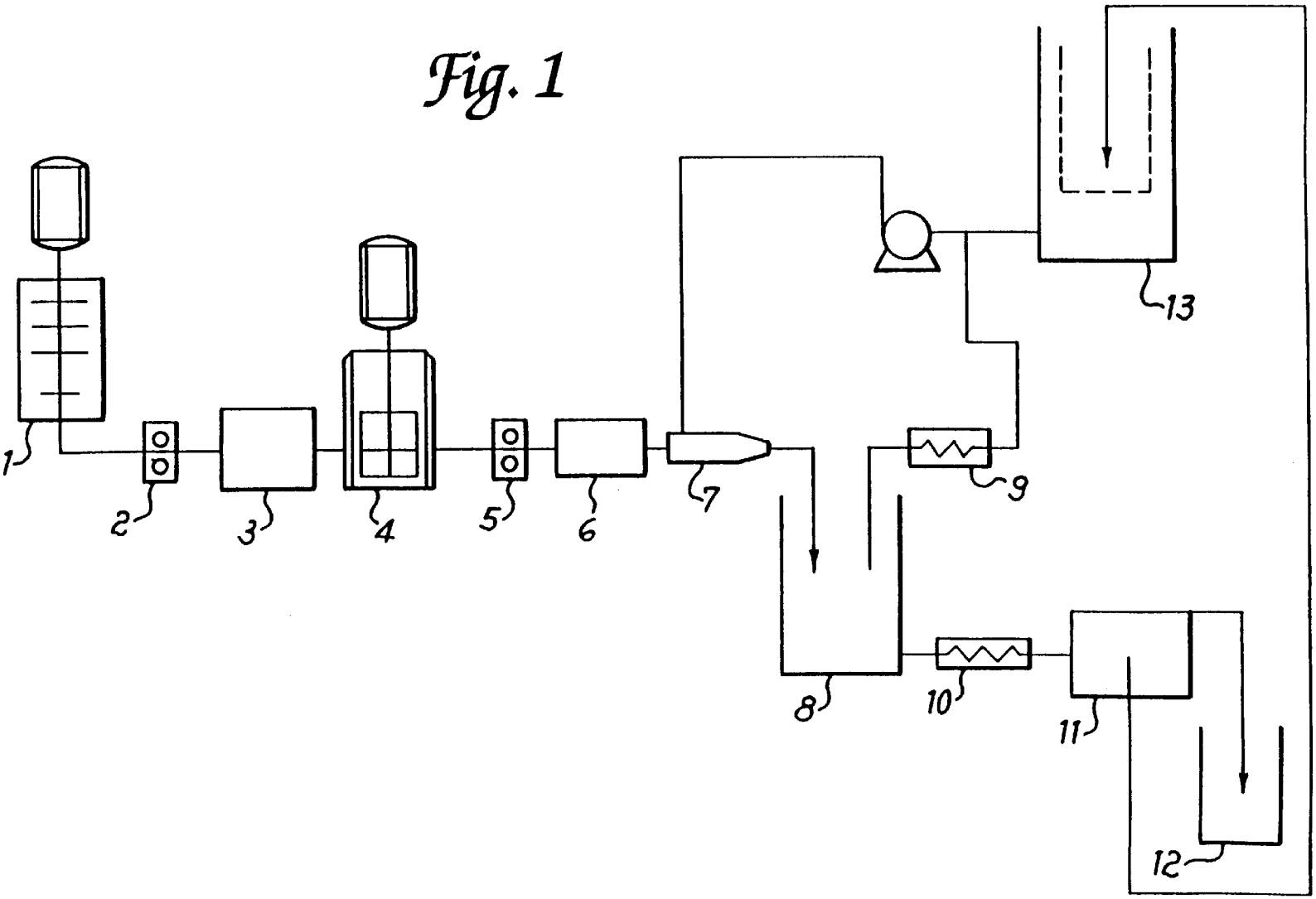
FIG. 1 illustrates a flow chart of the plant for carrying out the process.

With reference to the drawing in FIG. 1, 1 indicates a stirred dispersion for the preparation of the starch suspension in water with a dry weight typically from 5 to 50% by weight and preferably 10–40% by weight. The starch used for the preparation of the suspension is preferably natural starch such as starch from maize, rice, tapioca, potato having a amylopectin content from 30 to 100%. Particularly preferred is maize starch, widely available on the market, having a typical amylopectin content of from 64–80% by weight. Within the scope of the invention, starch with a high content of amylose, such as amylomaize and chemically or physically modified starch can be used.

The starch suspension can also contain additives such as salts (e.g. saline coagulating agents as described in U.S. Pat. No. 4,853,168) alkaline agents, organic fillers or minerals, crosslinking agents, plasticisers, polyoxyethylene, polyvinyl alcohol, ionomeric polymers such as copolymers of ethylene and acrylic acid and/or maleic anhydride, polyacrylates, polyamides, lubricants such as lecithin, fatty acids, esters and amides of fatty acids.

The suspension, maintained in the disperser under stirring at ambient temperature, is then pumped via a gear pump 2 into a jet cooker, itself indicated with 3, where it is mixed in a cocurrent with steam in such a way as to reach the desired cooking temperature. The jet cooking process is known per se and involves instantaneous heating of the aqueous suspension with process steam and then maintaining the heated liquid for a predetermined period. The cooking temperature, generally between 90° and 180° C., is selected according to the specific starch used in the course of the process. In particular, care should be taken to avoid an excessively high temperature causing degradation of the starch material, while ensuring that the temperature, the shearing time applied and the standing time are such that it is possible to obtain a dispersion close to complete gelation.

At the outlet of the jet cooker, the starch dispersion or solution subject to cooking is collected whilst stirring in a lined stirred reactor 4, and water circulating at a temperature of about 100° C. in the casing thereof. A flash is effected in this lined tank in order to free the excess steam and to return the starch/water concentrations close to the initial concentrations.

From reactor 4 the starch is pumped via a pump 5, in a heat exchanger 6 where it is brought to a temperature of between 20° and 100° C., preferably from 40° to 70° C. From the heat exchanger, the starch is fed to a fiber making device of the types illustrated in FIGS. 2 and 3, described in the following, in which a saline coagulating solution is also injected. The salts that can be used in the scope of the present invention comprise ammonium sulphate, magnesium sulphate, aluminium sulphate, ammonium phosphate, potassium chloride, sodium sulphate, sodium carbonate, sodium bicarbonate, and ammonium chloride. The preferred saline solution is a saturated solution of ammonium sulphate, although it is not necessary to reach saturated levels of the above mentioned salts and it is equally possible to use concentrations lower than saturation levels.

The starch fibers obtained from the fiber making device are collected in a stirred reactor 8 in order to be subjected to maturing and subsequently decanting. Once the decanting has been effected the clarified substance is recycled, by means of a pump 9, and mixed with a saturated saline solution of the coagulating agent before being reused for drawing the starch.

The clarified substance which circulates in the installation as a coagulating agent, contains the saline solution and the finest fibers which, due to their small dimensions are not decanted in the collecting container.

The mass of fibers from reactor 8 is pumped by means of pump 10 on to filter 11. The fibers are then collected in a container 12, while the filtrate is fed to container 13 where it is mixed with the clarified substance from pump 9, with subsequent addition of sulphate in order to recycle the saline solution adapted to be fed into fiber making device 7.

By using an appropriate number of reactors 8 for the maturing and decanting, it is possible for the process to be carried out continuously, thereby obtaining starch fibers which can be washed directly on the filter or simply filtered and subsequently washed.

Figure 2:
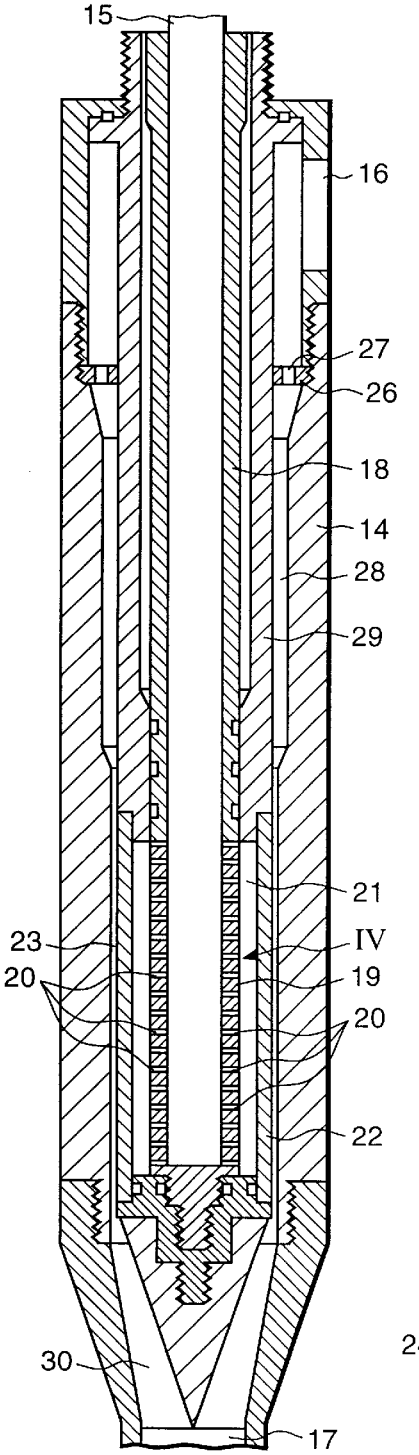
FIG. 2 shows a cross section view of the fiber making device according to the invention.

The fiber making device 7, in the embodiment in FIG. 2, comprises a tubular body 14 having at least one inlet 15 which, under normal conditions, is used for feeding the starch material, an inlet 16 designed to feed the coagulating agent and a outlet 17 for discharging the starch fibers produced after the coagulation.

From the inlet 15 the starch material is immersed in a tubular duct 18 which partially terminates in a wall 19 supplied with radial holes 20. The holey wall part 19 acts as the distributor of the starch material flow towards a feeding chamber 21.

With the reference 22, the tubular element with microporous walls suitable for extruding the starch material from the feeding chamber 21 into the annular chamber 23 coaxially thereto is indicated. The chamber 23 is separated from the radially external surface of the element 22 and the radially internal surface of body 14.

The tubular element 22 can consist of a body of porous sintered metal material in which the distribution of the porous dimension is preferably comprised between 10 and 500 microns.

Figure 4:
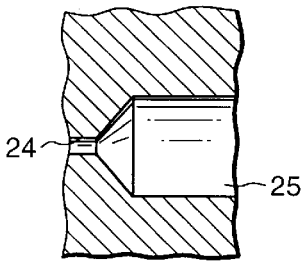
FIG. 4 is an enlarged detail of a part of FIGS. 2 and 3.

Alternatively the tubular element 22 is a body of metal material, for example stainless steel, provided with a number of radially passing holes obtained by mechanical working and having at least a narrow flow section with openings having a dimension preferably comprised between 10 and 500 microns. Preferably said radial holes have a cross section as illustrated in FIG. 4 with a portion 24 of the inlet for the starch material having a narrow opening, typically from 10 to 500 microns, and a portion 25 on the outlet of the starch material with an larger size opening, preferably comprised between 0.5 and 1.5 mm.

The opening density on the extrusion surface (intended as the surface of the tubular element in contact with the coagulating agent), expressed as a ratio of number of holes to surface area is preferably comprised between 4 and 0.05 holes/$mm^2$.

The coagulating agent fed through the inlet opening 16, flows through the annular element 26 having a crown of axial holes 27, acting as distributor, and is fed into the first annular chamber 28 defined by the walls 14 of the fiber making device and a tubular element coaxial to the body 29. From chamber 28 the flow is fed into the annular chamber of outlet 23, parallel to the radially external surface of the microporous tubular element 22, where the flow of coagulating agent interacts with the extrusion flow of the starch material.

The starch material is extruded in the form of a variety of threads which surround the extrusion surface in the guise of a tubular film.

Preferably the flow speed of the saline coagulating agent in the annular section of the outlet chamber 23 is maintained between 1 and 15 m/s.

The drawing ratio, intended as ratio of flow speed of the coagulating agent in the annular section of the chamber 23 and the speed of the starch material at the outlet of the holes of the microporous wall (defined as the ratio between the flow rate of the starch material and the total section in the holes of the outlet) is generally comprised between 1–1000, preferably between 100–1000. Preferably the axial length of the outlet chamber 23 is such that a stay time of the starch material comprised between 5 and 15 milliseconds is obtained. In any case the axial length of the chamber 23 in which the starch material undergoes drawing must be such to cause an orientation of the starch material allowing at the same time a complete phase inversion.

At the outlet of chamber 23 the extruded flow is fed into a annular chamber 30 at a progressively increasing cross section in the flow direction.

Figure 3:
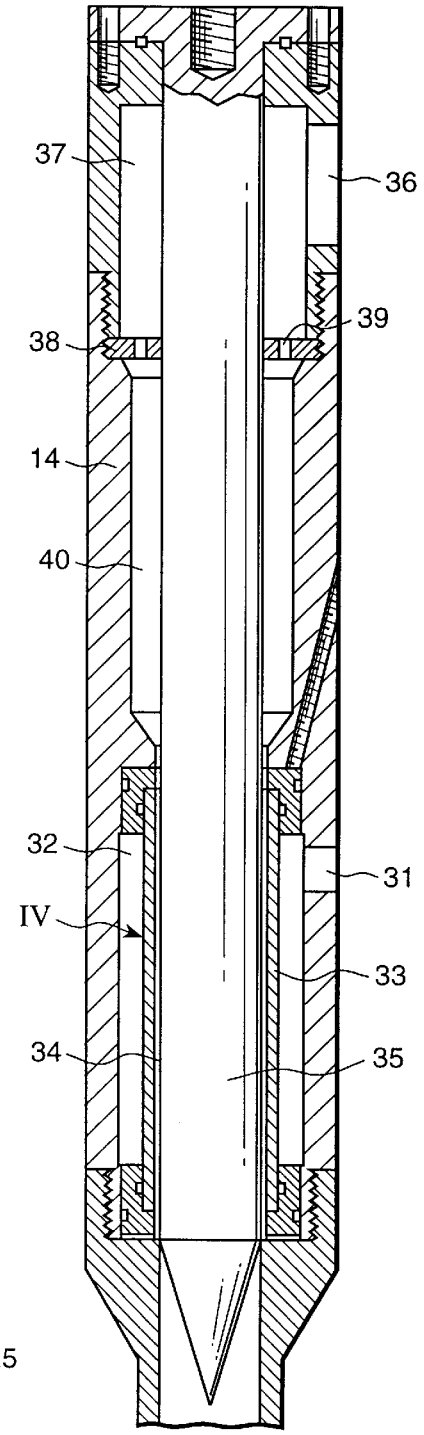
FIG. 3 shows a cross section view of another embodiment of the fiber making device.

In the embodiment of the fiber making device illustrated in FIG. 3, the flow of starch materials is fed through an inlet 31 to an annular chamber 32 defined by the walls of body 14 and the microporous walled tubular element 33. The flow of the starch material follows the radial direction towards the inside through the walls of element 33 into the annular outlet chamber 34 comprised between the tubular element 33 and a central nucleus 35 coaxial to the body. The flow of the coagulating agent is fed across an inlet 36 and into a prechamber 37, it flows into a chamber 40 across holes 39 of an annular element 38 and from chamber 40 is fed to the outlet chamber 34 having a narrow cross section in the flow direction.

In this embodiment the section of holes of the microporous element 33 remains the same as FIG. 4. In this case, however, the flow of the starch material advances from a bigger to a smaller cross section, which brings an increase in the starch flow speed and necking down of the starch threads. The material leaving the holes is coagulated by the coagulation agent flow in the annular chamber 34. It has been observed that the best conditions of coagulation are when the drawing ratio is comprised preferably between 1 and 150, with an emission speed of the starch material from the holes of the microporous walls 33 comprises preferably between 0.1 and 1 m/s.

The fiber making device subject of the present invention presents notable advantages such as:

- it supplies, through coagulation of a starch material, a product having a fibrous structure;
- its structure having a cylindrical symmetry guarantees uniformity of fluid mechanic conditions thus excluding possible border effects;
- its geometry is completely known and therefore project criteria are available.
- the knowledge of the above mentioned criteria permits its scale-up.

Other advantages deriving from the use of the above fiber making device, will be highlighted by the following examples.

EXAMPLE 1

By using a plant as described with reference to FIG. 1 maize starch fibers have been obtained working under the following conditions:

- starch concentration in the dispersion: 15 by weight (anhydrous starch)
- maximum cooking temperature in the jet cooker: 115° C. (preferred temperature range is between 100°–130° C.)
- temperature of the starch at the inlet of the fiber making device: 60° C.
- saline solution: ammonium sulphate: 41% by weight
- temperature of the saline solution at the fiber making device inlet: 21° C.
- maximum speed of the saline solution in the outlet chamber of the fiber making device: 7 m/s
- flow rate of the starch after cooking 48 l/h
- fibre making device as illustrated in FIG. 2 having a extrusion sinter consisting of a sintered metal with a porosity of 40 microns (average diameter of the pores)
- length of the outlet chamber (23,24) of the fiber making device: 10 cm
- average maturing time before filtering: 4 hours Carrying out the process according to the above mentioned conditions starch fibers were obtained having the following size distribution measured according to the Bauer McNett apparatus expressed in percent by weight:

595 μm (28 mesh)%: 0.3
297 μm (40 mesh)%: 3.1
149 μm (100 mesh)%: 68.5
74 μm (200 mesh)%: 21.3
above 200 mesh×100: 6.8

The determination of the characteristics of the solubility and the fiber obtained has been carried out by using the following procedure:

washing of the filtration panels coming from the plant; 100 g of the filtration cake are dispersed in water (500 ml) by mechanical stirring with a glass anchor stirrer under the following conditions:

Becker with diameter 10 cm and height 20 cm; mechanical glass anchor stirrer (1=40 cm with stirring blade with 1=8 cm, height 8 cm);

Temperature=20° C.; stirring time 30 mins; rotation speed 500 rpm.

The dispersion obtained is filtered on Bruckner with a diameter of 30 cm in the presence of a paper filter under vacuum of 10 mm Hg.

The liquid is filtered twice on the same panel. The panel is then washed with 500 ml of $H_2O$. The ratio of starch to water in the washing is 1:10.

The solubility determination is carried out on the filtered product, in order to separate it from the water and washed to remove the coagulant. The product is dispersed in water in a conventional laboratory pulper (dry concentration 0.2% rotation speed 3000 rpm); a sample was removed after 4 hours and after filtered on a 8 micron filter paper, the starch is measured in solution with the reagent "ANTHRONE" (solution 0.2% of ANTHRONE in 96% $H_2SO_4$).

The solubility value, determined by the above cited method on the filter panels obtained according to the example, is less than 1.5%.

The morphological characteristics of the fiber obtained are illustrated in FIG. 4.

EXAMPLE 2

The test according to example 1 has been repeated varying only the characteristics of the microporous sintered filter consisted, in this case of a sintered metal tube with pores having an average diameter of 100 $\mu$m. Fibres were obtained having the following size distribution expressed in terms of percentage by weight:

595 $\mu$m (28 mesh)%: 0.3
297 $\mu$m (40 mesh)%: 0.9
149 $\mu$m (100 mesh)%: 63
74 $\mu$m (200 mesh)%: 25.2
above 200 mesh×100: 10.6

The results demonstrate that the average diameter of the pores does not influence in a relevant way the fiber distribution that is maintained on a 100 and 200 mesh.

The solubility values obtained according to the method of example 1 are once again less than 1.5% like in the preceding case.

EXAMPLE 3 (COMPARATIVE)

The characteristics of the fibers obtained by the test in example 1 are compared to the fibrids obtained with the other fiber making devices, in particular ejector and spinneret.

The process conditions are the same as for example 1.

The first fiber making device consists of an ejector equipped with 8 holes in a 1 mm diameter, for the starch inlet with an inclination of 45° with respect to ejector axis placed in the groove. The speed of the coagulating agent (ammonium sulphate) in the thinner section is equal to 31 m/s and the draw ratio, (defined as the ratio between the maximum speed of the sulphate to that of the starch leaving the holes) is equal to 47.

The second fiber making device consists of a spinneret equipped with 113 holes having a diameter of 0.5 mm; this spinneret is placed in a circular duct and the annular crown separated from the external surface of the spinneret and the internal walls of the circular duct is fed with the coagulating agent, ammonium sulphate: the speed of the ammonium sulphate and that of the starch material exiting the holes are parallel. At the holes outlet, the starch material is contacted with the coagulating agent; the suspension formed then enters in a convergent (having a minimum diameter of 4 mm which corresponds to a sulphate speed of 30 m/s) in which the high turbulence completes the coagulation.

Table 1 reports the comparison of the fiber distribution for the various products; as can be noted, with the ejection fibers there is a high percentage of fine particles (80%) which reduces when passing to the spinneret and the tubular. The distribution curve is also different for these two fiber making devices very narrow for the tubular (90% of the particles between 100 and 200 mesh), larger for the spinneret.

This size distribution, combined with the particle form (similar to fibers with a marked form ratio such as for tubular; with high film content, furled and without a preferred direction in the case of the spinneret) is responsible for the different behaviour of the two products in the paper preparation together with the cellulose fibers. In fact it has been experimentally verified that the products obtained from the tubular fiber making device does not give rise to problems (of moulding or desiccation) in the preparation of sheets in the laboratory while the use of the product from the spinneret, starting from a certain percentage, gives sheets with surface defects and with a tendency to stick to the sheet forming plate.

Table 2 reports the percentage of starch retained on the sheet of paper prepared in the laboratory with the Rapid-Koethen apparatus, after dispersion of the cellulose—starch material paste (at 10% of the latter) in the pulper for 2 hours at 3000 rpm at ambient temperature. As noted the highest retention is with the product from the tubular fiber making device.

Table 3 finally highlights the behaviour of the two different products when filtered from the slurry after the coagulation and washing until the ammonium sulphate has been eliminated, the concentrations of the slurry and the maturing time being equal. As shown the products obtained from the tubular fiber making device show a double productivity with respect to those of the spinneret.

Moreover another subject of the present invention are the starch fibers obtainable through the previously described method that present the characteristic of having a solubility of less than 2% and a dimension distribution as such of 90% has a dimension such as to enter in the range of from 100 to 200 mesh, after classification by the Bauer-McNett apparatus.

TABLE 1

SRC Distribution with various fiber making devices

| Fiber making | Distribution (% w/w) | | | | |
|---|---|---|---|---|---|
| device | 28 | 50 | 100 | 200 | >200 |
| spinneret | 0.1 | 7.6 | 35.3 | 31.0 | 26 |
| ejector | 0.3 | 0.4 | 4.2 | 14.6 | 80.5 |
| tubular | 0.3 | 3.1 | 68.5 | 21.3 | 6.8 |

TABLE 2

Retention of starch fibers/fibrids in the paper

| Fiber making device | Retention % |
|---|---|
| Spinneret | 87.5 |
| Ejector | 77 |
| Tubular | >95 |

TABLE 3

| Filtering capacity of various starch fibers/fibrids | |
|---|---|
| Fiber making device | Filtered solid (Kg/h) |
| tubular | 20 |
| spinneret | 10 |

We claim:

1. A process comprising the steps of:

forming fibers of starch material by:

extruding an aqueous dispersion of starch material or a solution of starch material through a stationary microporous tubular wall into a chamber coaxially disposed with said microporous wall; and coagulating said starch material in said chamber by feeding a coagulation agent into said chamber.

2. A process according to claim 1, wherein said microporous wall defines a plurality of holes, each of said holes having a section with an average diameter between 10 and 500 microns, and wherein a density of said plurality of holes in said microporous wall is between 4 and 0.05 holes/mm$^2$.

3. A process according to claim 2, wherein the starch material resides in said chamber between 5 and 15 milliseconds.

4. A process according to claim 2, wherein each of the holes in said microporous wall has a narrow inlet section having an opening size of from 10 to 500 microns and a larger outlet section having an opening size greater than the opening size of said narrow inlet section, said starch material enters into the inlet section of each of said plurality of holes and exits from the outlet section of each of said plurality of holes such that a draw ratio is between 100 and 1000.

5. A process according to claim 4, wherein the starch material resides in said chamber between 5 and 15 milliseconds.

6. A process according to claim 2, wherein each of the holes in said microporous wall has a narrow outlet section having an opening size of from 10 to 500 microns and a larger inlet section having an opening size greater than the opening size of said narrow outlet section, said starch material enters into the inlet section of each of said plurality of holes and exits from the outlet section of each of the plurality of holes such that a draw ratio is between 1 and 150.

7. A process according to claim 6, wherein the starch material resides in said chamber between 5 and 15 milliseconds.

8. A process according to claim 1, wherein the starch material resides in said chamber between 5 and 15 milliseconds.

9. A process according to claim 1, wherein said chamber is annular.

10. A process according to claim 1, wherein said coagulating starch material flows parallel to the tubular wall.

11. A fiber making device, comprising:

a tubular body having a first inlet for receiving a flow of starch material;

a central member disposed coaxially with said tubular body;

a stationary tubular porous wall through which said starch material may be extruded coaxially disposed between said tubular body and said central member, said tubular body and said tubular porous wall defining a feeding chamber therebetween, said feeding chamber being connected to said first inlet, said central member and said tubular porous wall defining an annular outlet chamber therebetween; and a second inlet connected to said annular outlet for receiving a flow of coagulating agent and directing the flow of coagulating agent to said annular outlet chamber; and a discharge chamber arranged downstream from and connected to the annular outlet chamber for discharging said starch material.

12. A fiber making device according to claim 11, wherein said tubular porous wall is comprised of a sintered metal having a plurality of pores, each of said plurality of pores having an opening size between 10 and 500 microns.

13. A fiber making device according to claim 12, wherein an area density of said plurality of pores in said tubular porous wall is from 4 to 0.05 pores/mm$^2$.

14. A fiber making device according to claim 11, wherein said tubular porous wall defines a plurality of radially disposed holes, each of said holes having a narrow section with an opening dimension between 10 and 500 microns.

15. A fiber making device according to claim 14, wherein an area density of said plurality of pores in said tubular porous wall is from 4 to 0.05 pores/mm$^2$.

16. A fiber making device according to claim 14, wherein said annular outlet chamber is disposed radially outwardly of said feeding chamber.

17. A fiber making device according to claim 16, wherein each of said radially disposed holes has a section opened to said feeding chamber and has an opening size between 10 and 500 microns and wherein each of said radially disposed holes has a section opened to said outlet chamber and has an opening size larger than the opening size of said section opened to said feeding chamber.

18. A fiber making device according to claim 14, wherein said annular outlet chamber is disposed radially inwardly of said feeding chamber.

19. A fiber making device according to claim 18, wherein each of said radially disposed holes has a section opened to said outlet chamber and has an opening size between 10 and 500 microns and wherein each of said radially disposed holes has a section opened to the feeding chamber and has an opening size larger than the opening size of said section opened to said outlet chamber.

20. Starch fibers obtained through a process according to any one of the claims, said fibers having a solubility of less than 2% and wherein 90% of the fibers are from 100 to 200.

* * * * *